United States Patent [19]

Harper et al.

[11] Patent Number: 4,480,440

[45] Date of Patent: Nov. 6, 1984

[54] TURBOCHARGER COMPRESSOR END VENTILATION SYSTEM

[75] Inventors: Allan C. Harper, Indianapolis; Edwin L. Jones, New Palestine; Ivan D. Beaver, Indianapolis, all of Ind.

[73] Assignee: Wallace Murray Corporation, New York, N.Y.

[21] Appl. No.: 370,407

[22] Filed: Apr. 21, 1982

[51] Int. Cl.[3] ..... F02B 37/04

[52] U.S. Cl. ..... 60/605; 417/407

[58] Field of Search ..... 60/605; 417/407; 415/180; 184/6.11, 6.16

[56] References Cited

U.S. PATENT DOCUMENTS 3,077,296 2/1963 Ping, Jr. ..... 415/180

3,834,156 9/1974 Cutler et al. ..... 60/605

*Primary Examiner*—Michael Koczo

*Assistant Examiner*—Peggy A. Neils

*Attorney, Agent, or Firm*—Thomas J. Greer, Jr.

[57] ABSTRACT

This relates to improvements in turbochargers and more particularly to the venting of the bearing housing of a turbocharger adjacent the compressor housing. Under certain operating conditions, insufficient air is available for the compressor intake, with the result that the compressor draws a vacuum within the compressor housing and causes an undesirable flow of lubricant from the turbocharger bearings to the compressor discharge. This vacuum is applied to the interior of the bearing housing in the general area of the oil deflector and thrust bearing. A vent passage is formed through the oil deflector and the thrust bearing and down between the thrust bearing and bearing support so as to vent that portion of the bearing housing to the lubricant drain cavity, and thereby inhibit undesirable lubricant flow to the compressor discharge.

12 Claims, 7 Drawing Figures

TURBOCHARGER COMPRESSOR END VENTILATION SYSTEM

This invention relates to the venting of the bearing housing of a turbocharger adjacent the compressor end to prevent excessive lubricant being present adjacent the compressor wheel whereby when excessive vacuums are drawn by the compressor wheel within the compressor housing, as will occur during certain operating conditions of an associated internal combustion engine, the drawing of lubricant from the bearing housing into the compressor housing and the delivery of such lubricant to the internal combustion engine may be maintained at a minimum.

U.S. Pat. No. 3,834,156 issued to Cutler et al on Sept. 10, 1974, and assigned to the assignee of the present invention; presents a detailed analysis of the problem and a prior solution.

The present invention relates to the prevention of oil leakage at the compressor end of a turbocharger through the compressor piston ring seal area. In certain present turbocharger hardware designs, with bearing clearances and piston ring gap, oil can leak from the bearing into the compressor end when the compressor inlet is restricted. For test purposes, such compressor inlet restriction is required by certain engine manufacturers.

When the compressor is restricted, thereby creating a vacuum behind the compressor wheel, the vacuum will draw either lubricant or air from the bearing housing lubricant cavity. Prior to this invention, the hardware arrangement did not allow air to follow the path of equilibrium. As a result, excessive lubricant was present in the insert/oil deflector pocket and thus lubricant is pumped to the compressor cover through the bearing clearance and piston ring gap.

Turbocharger bearings are lubricated by oil pumped from the associated engine. This lubricant is then drained back into the engine crankcase. By designing the oil return line to the engine crankcase sufficiently large, gases within the engine crankcase will be drawn into the bearing housing, and more particularly into the lubricant return cavity.

In accordance with this invention, the pocket where lubricant normally would accumulate is vented into a lubricant return cavity.

According to the practice of this invention, a vent passage is formed through the thrust bearing and a vent channel or passage is formed either between the thrust bearing and the end of the bearing support of the bearing housing or in the form of a bore in the bearing housing. When the vent passage is formed entirely within the bearing housing, communication, between the thrust bearing vent passage and the bearing housing vent passage is by way of a hollow pin carried by the bearing housing and seated within the thrust bearing vent passage with the pin also preventing rotating of the thrust bearing. In this manner, the pocket where lubricant could accumulate is always vented to the lubricant return cavity. This arrangement has solved the above-noted lubricant leakage problem.

Figure 1:
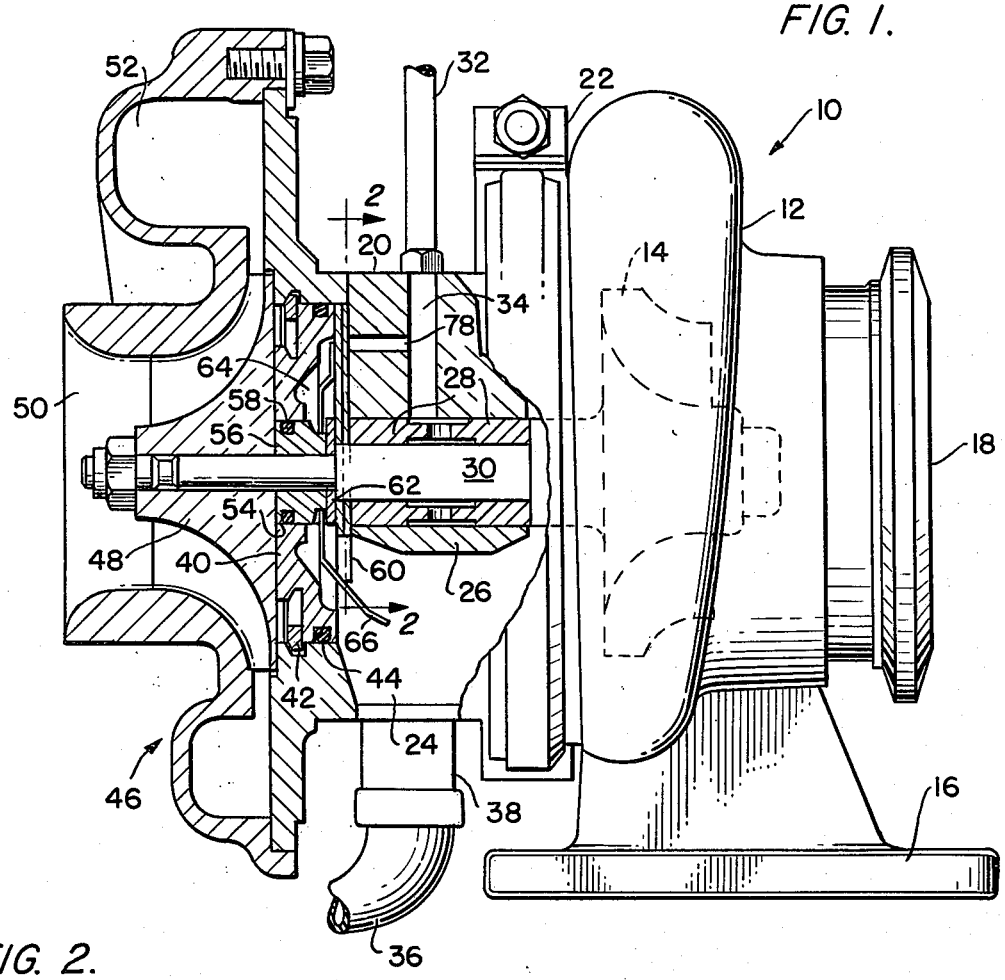
FIG. 1 is a side elevational view of a turbocharger formed in accordance with this invention with portions broken away and shown in section.

Referring to the drawings, a conventional type of turbocharger modified in accordance with this invention is illustrated. The turbocharger is generally identified by the numeral 10 and includes a turbine housing 12 in which there is mounted for rotation a turbine wheel 14. The turbine housing is provided with a flanged inlet 16 which is coupled to the exhaust manifold of an associated internal combustion engine (not shown). The turbine housing also includes an exhaust outlet 18 for the radial inflow wheel 14.

The central portion of the turbocharger 10 includes a bearing housing 20 to which the turbine housing 12 is connected by way of a clamp ring 22.

The bearing housing 20 is hollow and includes a lubricant return cavity 24 into which extends a tubular bearing support 26 carrying bearings 28. The bearings 28 mount wheel shaft 30 for rotation.

Lubricating oil is supplied to the bearing housing 20 through a supply line 32 which feeds a supply passage 34, which in turn leads into tubular bearing support 26. Lubricant draining from the bearings 28 is directed back into the crankcase (not shown) of the associated internal combustion engine by way of drain or return line 36. The line 36 is coupled to the bottom of the lubricant drain cavity 24 by a suitable fitting 38 of a size in excess of that required for the return of lubricant to the engine crankcase. Thus gases within the engine crankcase may be drawn into cavity 24 of the bearing housing 20 under certain conditions.

The end of bearing housing 20 facing the compressor portion of the turbocharger is closed by an insert 40 which is maintained in place by a snap ring 42. A sealing ring 44 fits between disc insert 40 and the housing. However, as will be explained hereinafter, under severe operating conditions a vacuum will be drawn past the piston ring seal 58 into the bearing housing 20.

The left end of bearing housing 20 is provided with a compressor housing 46 in which a compressor wheel 48, carried by the shaft 30, is rotatably journalled. The compressor housing 46 defines an inlet 50 and a discharge or collection area 52 which will be directed to the intake manifold of an associated internal combustion engine.

The insert 40 is provided with a central opening 54 in which there is rotatably journalled a lubricant flinger 56 carried by the shaft 30. The lubricant flinger 56 is provided with a piston ring seal 58 relative to the insert.

A thrust bearing 60 surrounds the shaft 30 at the compressor end of the bearing support 26. Between the thrust bearing 60 and the lubricant flinger 56 is a thrust ring or washer 62.

In the upper part of the bearing housing 20 adjacent the insert 40 there is a pocket 64 in which lubricant may accumulate. This is in part due to the pressures at the lubricant flinger 56 an an associated lubricant or oil deflector 66.

In accordance with this invention, it is proposed to vent the lubricant collection area 64 to the lubricant drain cavity 24 from which vapors and gases from the internal combustion engine crankcase may be drawn in the case of severe vacuums.

Under certain operating conditions, the inlet 50 of the compressor may be greatly restricted. The continued high speed rotation of the compressor wheel 48 will then result in a vacuum being drawn within the compressor housing 46 in the area of the compressor wheel 48 and thus in the area of the insert 40. The result is that a vacuum is drawn through the clearances of the piston ring seal 58 into the bearing housing 20, its associated cavity 24, and the pocket 64. Thus should there be any accumulation of lubricant within the lubricant collection area 64 at the occurrence of such vacuum conditions, this lubricant will be drawn into the compressor housing 46 and subsequently introduced into the cylinders of the internal combustion engine. This, of course, is undesirable both from an operating standpoint and an oil usage standpoint.

Figure 3:
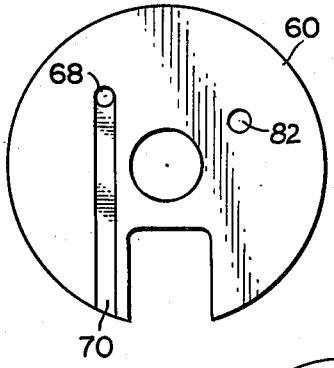
FIG. 3 is an elevational view of one face of the thrust bearing and shows the formation of a portion of the vent passage in that face.
Figure 4:
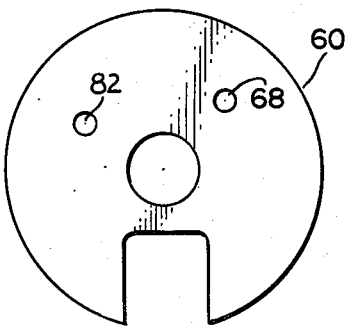
FIG. 4 is an elevational view showing the other face of the thrust bearing.

In accordance with this invention, the lubricant collection area 64 is vented to the lubricant drain cavity 24 in a very simple manner. As is clearly shown in FIGS. 3 and 4, the thrust bearing 60 is provided with a bore 68 therethrough which defines a first portion of a vent passage. In addition, that face of the thrust bearing 60 which opposes the bearing support 26 is provided with a vertical groove or slot 70.

Figure 2:
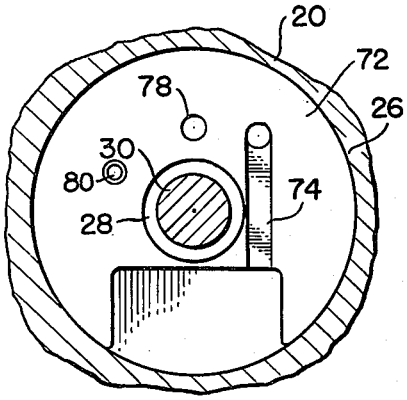
FIG. 2 is an enlarged fragmentary vertical sectional view taken generally along the 2—2 of FIG. 1 and shows the formation of at least a portion of the vent passage in the end of the bearing support.

Referring now to FIG. 2, it will be seen that an end face 72 of bearing support 26 also has formed therein a vertical slot or groove 74. The slots or grooves 70 and 74 are positioned to cooperate with each other and to form a vertical vent passage portion of a size corresponding to the affected cross-sectional area of the bore 68.

It is also to be noted that the oil deflector 66 is provided with a vent opening 76 which is aligned with the vent opening 68 in the thrust bearing 60. In this manner the lubricant collection area 64 is placed in direct communication with the lubricant drain cavity 24 without the utilization of any special fittings, hoses, etc.

With reference to FIG. 2, the end surface 72 of the bearing support 26 has a lubricant passage 78 opening for supplying the lubricant to the thrust bearing 60.

Although the vent passage between the thrust bearing 60 and the bearing support 20 has been illustrated as being formed partially in the thrust bearing by way of a groove 70 and partially in the bearing support by way of a groove 74, it will be apparent that either of the grooves 70 and 74 may be of a cross-section to provide the necessary vent passage. This is particularly true of the groove 74 which can be made much deeper. Also, the outline of the thrust bearing 60 may be such that the vent passage 68 may not be needed with the vent flow being around the thrust bearing 60.

Normally the bearing support 26 has projecting from the one end thereof a pin 80 which passes through an aperture 82 in the thrust bearing 60 so as to prevent rotation of the thrust bearing 60 with respect to the bearing support 26. In a modified and preferred embodiment of the invention, as shown in FIGS. 6 and 7, a similar pin 84, which is hollow, performs the dual function of forming part of a vent passage and also functioning in the usual capacity as a thrust bearing retaining pin.

Figure 6:
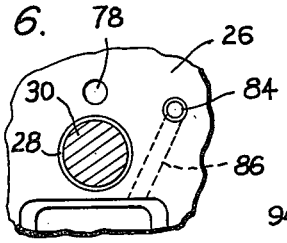
FIG. 6 is a fragmentary elevational view of the end of the bearing support and shows specifically the formation of the vent passages drilled in the bearing support and a hollow retaining pin mounted in one of the drilled vent passages.

Instead of a vent passage which is formed either by a groove in the end of the bearing support 26, a groove in one face of the thrust bearing 60 or a combination of both, the equivalent of the vent passage which is a combination of the passes 70 and 74 is in the form of a bore 86 which slopes downwardly through the bearing support 26, as is best shown in FIG. 6.

Figure 7:
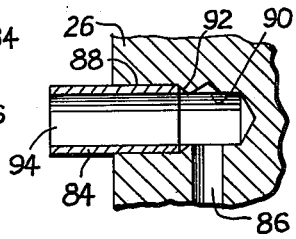
FIG. 7 is an enlarged fragmentary longitudinal sectional view showing the formation of the vent passage in the bearing support and the mounting of the hollow pin.
Figure 5:
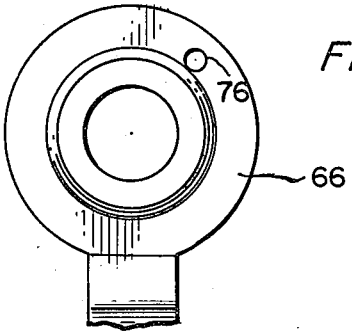
FIG. 5 is an elevational view of the oil deflector shown in FIG. 1.

As is best shown in FIG. 7, it will be seen that the vent passage 86 is recessed from the one end of the bearing support 26. Thus it may be readily formed by means of a drilled bore.

It is also to be seen that that portion of the vent passage which extends generally parallel to the shaft 30 is of a two step configuration including an axially outermost bore 88 and an axially innermost bore 90 which is of a smaller diameter than the bore 88 so as to provide for a stepped arrangement. The hollow pin 84 is driven into the bore 88 and abuts against a shoulder like portion 92 formed due to the diameter differences between the two bores.

It is to be understood that the bore 68 or the equivalent thereof through the thrust bearing 60 is of a diameter to tightly receive the pin 84. It will thus be seen that the pin 84, which is hollow, in of itself defines a vent passage portion 94.

The occurrence of vacuum conditions in the compressor will thus result in engine crankcase gases passing to the compressor, instead of liquid lubricant passing to the compressor. This is because the liquid lubricant in collection area 64 cannot accumulate there, it drains away from area 64, as a result of the venting of the gases.

We claim:

1. A turbocharger for internal combustion engines, said turbocharger being of the type including a bearing housing having a lubricant drain cavity and a bearing support projecting into said lubricant drain cavity, a lubricant supply line for directing lubricant into said bearing support and a drain line for draining lubricant from said lubricant drain cavity into an engine crankcase, an insert closing one end of said bearing housing, a shaft rotatably journalled in said bearing support and extending through said insert, a thrust bearing abutting one end of said bearing support, a compressor wheel carried by said shaft on the side of said insert remote from said thrust bearing, the improvement comprising said insert together with said thrust bearing defining a lubricant collection area, and passage means for venting engine crankcase gases through said thrust bearing and between said thrust bearing and said one end of said bearing support for venting to said lubricant collection area from said lubricant drain area, whereby under vacuum conditions in the compressor, crankcase gases are drawn into said lubricant collection area through said passage means for venting said lubricant collection area and flow of lubricant from the bearing housing into the compressor is inhibited.

2. A turbocharger according to claim 1 wherein said means for venting crankcase gases includes a first vent passage portion generally parallel to said shaft and a second vent passage portion generally transversely of said shaft.

3. A turbocharger according to claim 2 wherein said passage first vent passage portion is at an elevation above said shaft and said second vent passage portion is generally vertical.

4. A turbocharger according to claim 1 wherein said passage means for venting crankcase gases includes a vent passage portion formed at least in part in that face of said thrust bearing opposing said bearing support one end.

5. A turbocharger according to claim 1 wherein said passage means for venting crankcase gases includes a vent passage portion formed at least in part in said bearing support one end.

6. A turbocharger according to claim 1 wherein said passage means for venting crankcase gases includes a vent passage portion formed in part in that face of said thrust bearing opposing said bearing support one end and in part in said bearing support one end.

7. A turbocharger according to claim 1 wherein said passage means includes a vent passage through said thrust bearing.

8. A turbocharger according to claim 7 including a lubricant deflector generally within said lubricant collection area, and a vent passage through said lubricant deflector in alignment with said vent passage through said thrust bearing and forming part of said passage means for venting crankcase gases.

9. A turbocharger for internal combustion engines, said turbocharger being of the type including a bearing housing having a lubricant drain cavity and a bearing support projecting into said lubricant drain cavity, a lubricant supply line for directing lubricant into said bearing support and a drain line for draining lubricant from said lubricant drain cavity into an engine crankcase, an insert closing one end of said bearing housing, a shaft rotatably journalled in said bearing support and extending through said insert, a thrust bearing abutting one end of said bearing support, a compressor wheel carried by said shaft on the side of said insert remote from said thrust bearing, the improvement comprising said insert together with said thrust bearing defining a lubricant collection area, and passage means for venting engine crankcase gases through said thrust bearing and said one end of said bearing support for venting to said lubricant collection area from said lubricant drain area, whereby under vacuum conditions in the compressor, crankcase gases are drawn into said lubricant collection area through said passage means for venting said lubricant collection area and flow of lubricant from the bearing housing into the compressor is inhibited.

10. A turbocharger according to claim 9 wherein said passage means for venting crankcase gases includes a first vent passage portion generally parallel to said shaft and a second vent passage portion generally transversely of said shaft.

11. A turbocharger according to claim 10 wherein said first vent passage portion includes aligned parts in said bearing support and through said thrust bearing, said bearing support has a positioning pin with one end portion of said pin being sealed in bearing support part of said first vent passage portion and extending from said bearing support one end, said pin also being received in said thrust bearing part of said first vent passage portion and preventing movement of said thrust bearing about said shaft, said pin being hollow to allow flow of engine crankcase gases through said first vent passage portion.

12. A turbocharger for internal combustion engines, said turbocharger being of the type including a bearing housing having a lubricant drain cavity an a bearing support projecting into said lubricant drain cavity, a lubricant supply line for directing lubricant into said bearing support and a drain line for draining lubricant from said lubricant drain cavity into an engine crankcase, an insert closing one end of said bearing housing, a shaft rotatably journalled in said bearing support and extending through said insert, a thrust bearing abutting one end of said bearing support, a compressor wheel carried by said shaft on the side of said insert remote from said thrust bearing, the improvement comprising said insert together with said thrust bearing defining a lubricant collection area, and passage means for venting engine crankcase gases through and adjacent said thrust bearing for venting to said lubricant collection area from said lubricant drain area, whereby under vacuum conditions in the compressor, crankcase gases are drawn through said passage means into said lubricant collection area for venting said lubricant collection area and flow of lubricant from the bearing housing into the compressor is inhibited.

* * * * *